US009822742B2

(12) United States Patent
Candela et al.

(10) Patent No.: US 9,822,742 B2
(45) Date of Patent: Nov. 21, 2017

(54) VALVE FOR CONTROLLING PISTON COOLING JETS IN AN INTERNAL COMBUSTION ENGINE

(71) Applicant: GM GLOBAL TECHNOLOGY OPERATIONS LLC, Detroit, MI (US)

(72) Inventors: Giorgio Candela, Turin (IT); Giuseppe Larocca, Potenza (IT)

(73) Assignee: GM GLOBAL TECHNOLOGY OPERATIONS LLC, Detriot, MI (US)

( * ) Notice: Subject to any disclaimer, the term of this patent is extended or adjusted under 35 U.S.C. 154(b) by 255 days.

(21) Appl. No.: 14/626,121

(22) Filed: Feb. 19, 2015

(65) Prior Publication Data

US 2015/0240699 A1 Aug. 27, 2015

(30) Foreign Application Priority Data

Feb. 24, 2014 (GB) ..... 1403239.5

(51) Int. Cl.
*F01P 1/04* (2006.01)
*F02M 35/10* (2006.01)
*F01P 3/10* (2006.01)

(52) U.S. Cl.
CPC ..... *F02M 35/10229* (2013.01); *F01P 3/10* (2013.01)

(58) Field of Classification Search
CPC .... F01M 1/08; F01M 1/16; F01M 2001/0238; F01P 3/08; F01P 2003/006; F01P 7/14; F01P 11/18; F16K 11/044; F16K 17/048; F16N 2280/00
See application file for complete search history.

(56) References Cited

U.S. PATENT DOCUMENTS 3,045,420 A * 7/1962 Addie ..... F01M 1/02 123/41.15
4,890,695 A * 1/1990 Morris ..... F01M 1/16 123/196 R
4,966,105 A * 10/1990 Mori ..... F01M 3/02 123/196 R
2008/0232981 A1* 9/2008 Zhou ..... F04C 18/3442 417/284
2012/0132172 A1* 5/2012 Kobayashi ..... F01M 1/08 123/196 R (Continued)

FOREIGN PATENT DOCUMENTS

CN 103603703 A 2/2014
GB 1005553 A 9/1965
GB 2480474 A 11/2011

OTHER PUBLICATIONS

UKIPO, Great Britain Search Report for GB1403239.5, dated Sep. 11, 2014.

*Primary Examiner* — Marguerite McMahon
*Assistant Examiner* — Tea Holbrook
(74) *Attorney, Agent, or Firm* — Lorenz & Kopf, LLP

(57) ABSTRACT

A valve for controlling piston cooling jets in an internal combustion engine is disclosed. The valve includes a valve body equipped with an oil inlet for drawing oil from an oil gallery and an oil outlet for connection with a piston cooling jet gallery. The valve body is equipped with an air inlet for drawing air from an intake manifold of the engine, and with a valve element configured to be actuated by the pressure of the oil entering the oil inlet and of the air entering the air inlet.

16 Claims, 4 Drawing Sheets

(56) References Cited

U.S. PATENT DOCUMENTS

| | | | | |
|---|---|---|---|---|
| 2014/0305392 | A1* | 10/2014 | Clement | F01P 3/08<br>123/41.35 |
| 2015/0377115 | A1* | 12/2015 | Shinagawa | F02P 5/152<br>123/41.15 |

* cited by examiner 500
610
620
720
650
OIL
AIR
700
632
630
634
690
710
660

500
610
620
720
650
OIL
AIR
700
690
632
630
634
640
710
660

500
610
620
700
730
650
OIL
AIR
690
632
630
634
640
710
660

VALVE FOR CONTROLLING PISTON COOLING JETS IN AN INTERNAL COMBUSTION ENGINE

CROSS-REFERENCE TO RELATED APPLICATION

This application claims priority to British Patent Application No. 1403239.5, filed Feb. 24, 2014, which is incorporated herein by reference in its entirety.

TECHNICAL FIELD

The present disclosure relates to a valve for controlling piston cooling jets in an internal combustion engine.

BACKGROUND

An internal combustion engine (ICE) for a motor vehicle generally includes an engine block which defines at least one cylinder accommodating a reciprocating piston coupled to rotate a crankshaft. The cylinder is closed by a cylinder head that cooperates with the reciprocating piston to define a combustion chamber. A fuel and air mixture is cyclically injected into the combustion chamber and ignited, thereby generating hot expanding exhaust gasses that cause the reciprocating movements of the piston. The fuel is injected into each cylinder by a respective fuel injector. The fuel is provided at high pressure to each fuel injector from a fuel rail in fluid communication with a high pressure fuel pump that increase the pressure of the fuel received from a fuel source.

Generally speaking, a lubrication system is provided in internal combustion engines, the lubrication system including Piston Cooling Jets or PCJs used to generate jets of oil onto the underside of the pistons. The oil may be used to absorb heat from the pistons and to lubricate the cylinders of the engine.

An oil circuit is provided for the PCJs, the oil circuit including an oil pump, the pump being generally driven by the crankshaft and drawing oil from an oil sump, an oil cooler and oil filter, the oil being circulated in a main oil gallery. In some applications, a dedicated PCJ oil gallery leading to the Piston Cooling Jets is provided and is separated from the main oil gallery by a solenoid valve, managed by an Electronic Control Unit (ECU) of the engine.

The use of a solenoid valve however causes several problems. First, the assembly of the solenoid valve requires a wiring harness in order to connect the valve to the ECU, contributing to the complexity of the wiring of the overall engine system. Furthermore, the use of the solenoid valve controlled by the ECU requires dedicated software to be run by ECU, contributing to the computational load of the ECU. These facts, in addition to the cost of the solenoid valve itself, increase the costs of the engine system.

SUMMARY

In accordance with the present disclosure, a valve for controlling piston cooling jets in an internal combustion engine is provided that reduces the complexity of installation of a traditional solenoid valve and helps to reduce the costs of the engine system. An embodiment of the present disclosure provides a valve for controlling piston cooling jets in an internal combustion engine. The valve includes a valve body equipped with an oil inlet for drawing oil from an oil gallery and an oil outlet for connection with a piston cooling jet gallery. The valve body is equipped with an air inlet for drawing air from an intake manifold of the engine and with a valve element configured to be actuated by the pressure of oil entering the oil inlet and of the air entering the air inlet. An advantage of this embodiment is that it allows control of the piston cooling jets without the need of a solenoid valve, reducing the number of engine components and the complexity of the overall wiring of the automotive system. Furthermore, since the valve of the above embodiment is not controlled by the ECU of the internal combustion engine, it does not need any software to be controlled, simplifying the ECU software. Therefore costs are reduced and reliability improved.

According to another embodiment of the present disclosure, the valve element is configured to be maintained in a position in which it closes the oil outlet as long as the air pressure balances the oil pressure. An advantage of this embodiment is that it allows the piston cooling jets valve to close at low engine speed and low engine load, namely when there is no need for cooling the pistons and a faster warm up of the engine may be desired.

According to a further embodiment of the present disclosure, the valve element is configured to be moved in a first position in which it opens the oil outlet when the air pressure exceeds the oil pressure. An advantage of this embodiment is that it allows the piston cooling jets valve to open at high engine load and low engine speed, namely when due to high engine load pressure of air from the intake manifold of the engine and entering the valve is increased. In this case, the piston cooling jets are operated, in particular for improving cooling of the pistons.

According to a further embodiment of the present disclosure, the valve element is configured to be moved in a second position in which it opens the oil outlet when the oil pressure exceeds the air pressure. An advantage of this embodiment is that it allows the piston cooling jets valve to open at high engine speed, namely when the oil pump, which is mechanically connected to the engine, increases the oil pressure. In this case, the piston cooling jets are also operated, in particular for improving lubrication of the pistons.

According to another embodiment of the present disclosure, the valve element is movable along an axial direction inside valve body as a consequence of different oil and air pressure conditions depending on different engine operating points. An advantage of this embodiment is that it simplifies the operations of the valve.

According to still another embodiment of the present disclosure, the valve body has openings in fluid connection with the oil outlet and the valve element is provided with an aperture suitable for establishing a fluid connection between the oil inlet and the oil outlet. An advantage of this embodiment is that it simplifies the construction of the valve.

According to still another embodiment of the present disclosure, valve element divides the valve body in an oil chamber fluidly connected to the oil inlet and an air chamber fluidly connected to the air inlet. An advantage of this embodiment is that it takes advantage of the pressure of two different fluids, namely oil and air.

According to another embodiment of the present disclosure, the valve element is connected to a spring housed in the air chamber. An advantage of this embodiment is that, by suitable choice of the elastic constant of the spring, it allows suitable valves to be designed for each particular automotive system.

Still another embodiment of the present disclosure provides an internal combustion engine including a piston cooling jet gallery provided with piston cooling jets for cooling a piston of the internal combustion engine, and the valve for controlling the flow of oil to the piston cooling jets. The advantages of this embodiment are substantially the same of the valve for controlling piston cooling jets according to the various embodiments of the present disclosure.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the application and uses of the present disclosure. Furthermore, there is no intention to be bound by any theory presented in the preceding background of the present disclosure or the following detailed description. Preferred embodiments will now be described with reference to the enclosed drawings.

Figure 1:
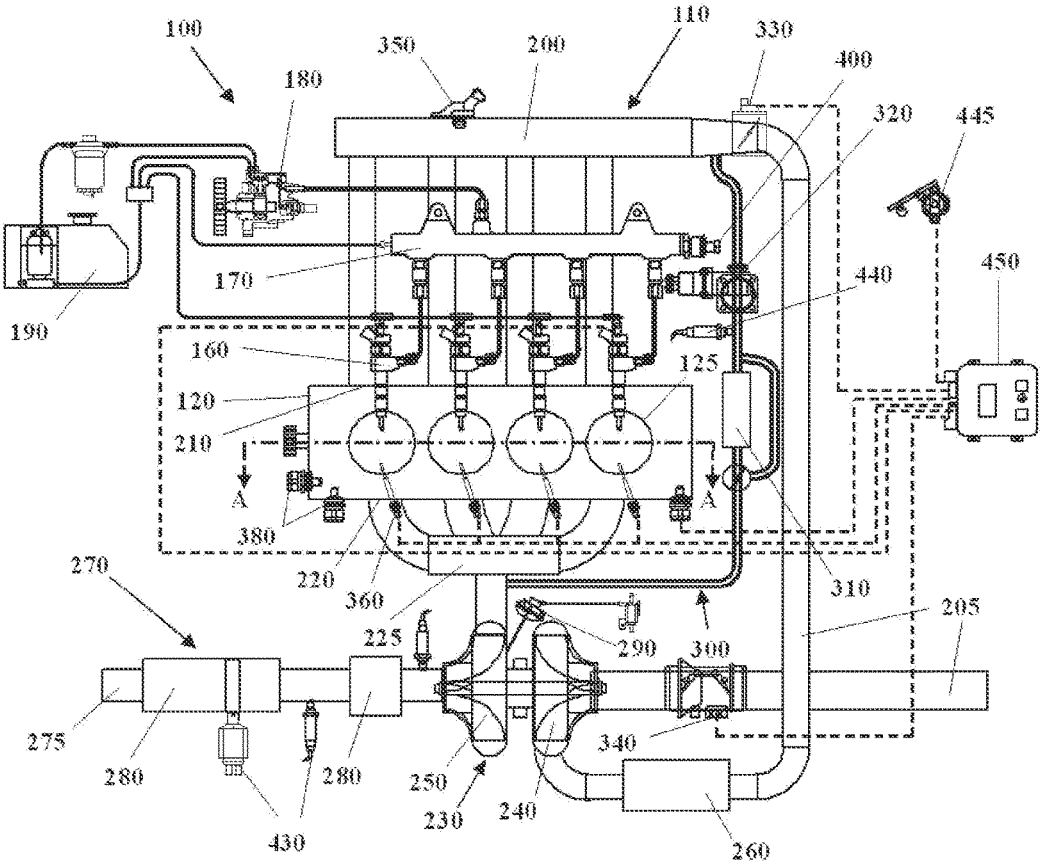
FIG. 1 shows an automotive system.
Figure 2:
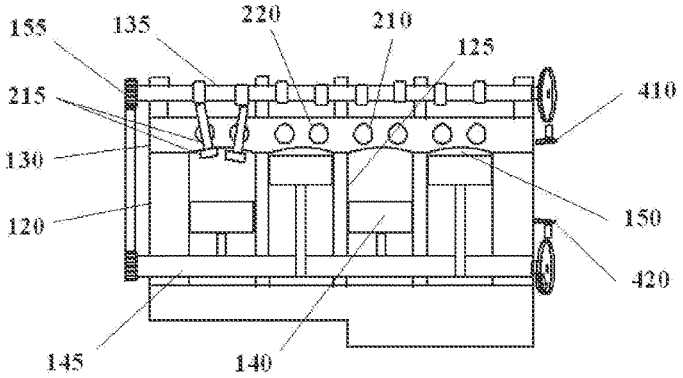
FIG. 2 is a cross-section of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145, the crankshaft 145 being housed in a crankcase. A cylinder head 130 cooperates with the piston 140 to define a combustion chamber 150. A fuel and air mixture (not shown) is injected into the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after treatment devices 280. The after treatment devices may be any device configured to change the composition of the exhaust gases. Some examples of after treatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Instead of an ECU 450, the automotive system 100 may have a different type of processor to provide the electronic logic, e.g. an embedded controller, an onboard computer, or any processing module that might be deployed in the vehicle.

Figure 3:
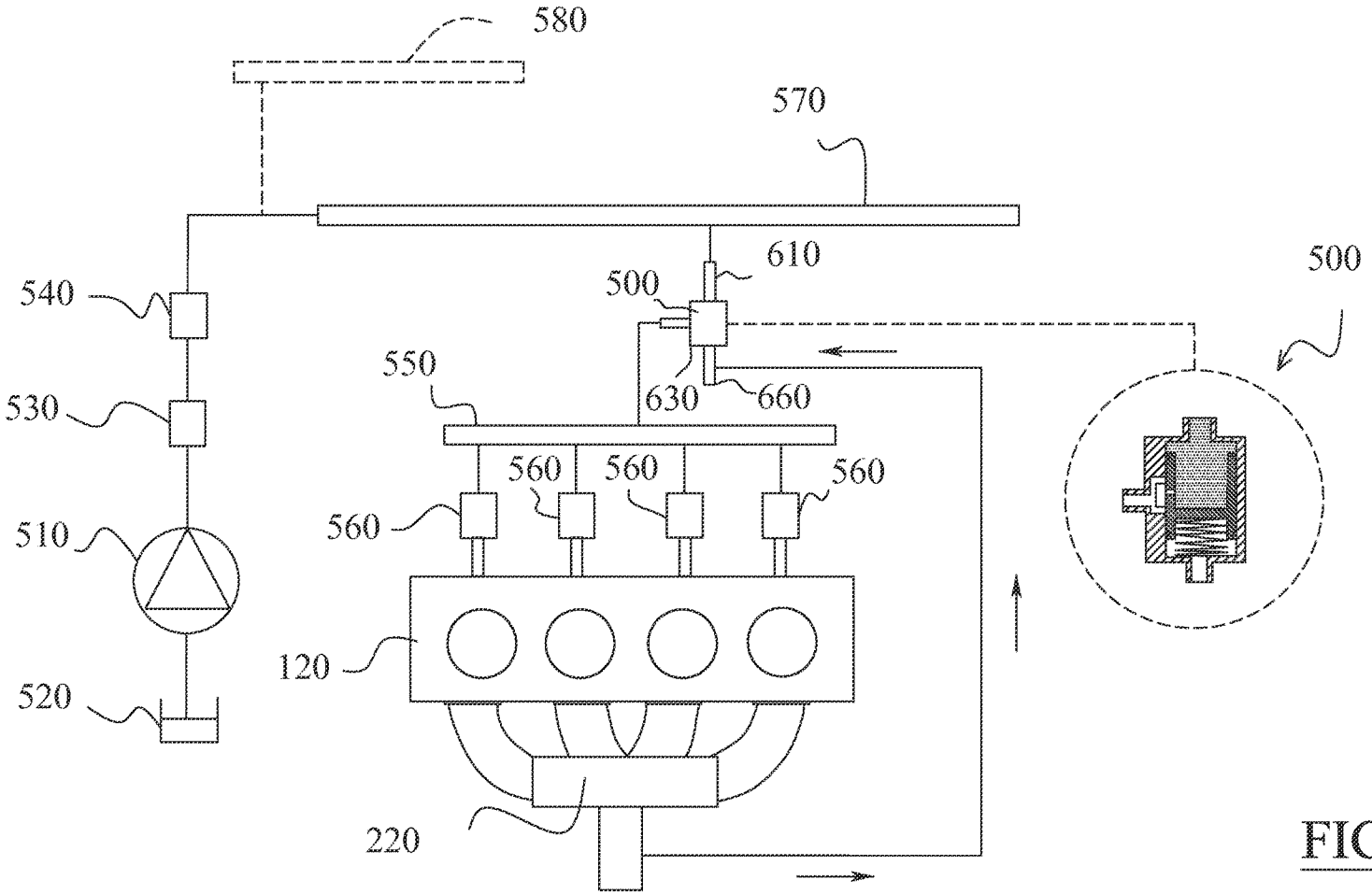
FIG. 3 is a schematic representation of an oil circuit including a valve for controlling piston cooling jets according to an embodiment of the present disclosure.

FIG. 3 is a schematic representation of an oil circuit 505 including a valve 500 for controlling piston cooling jets 560 according to an embodiment of the present disclosure. The piston cooling jets 560 are used, in an engine oil lubrication circuit 505, to generate jets of oil onto the underside of the pistons 140. The oil may absorb heat from the pistons and may also lubricate the cylinders 125 of the engine. The oil circuit 505 includes an oil pump 510 drawing oil from an oil sump 520, an oil cooler 530 and oil filter 540, the oil being circulated in a main oil gallery 570 and in other portions 580 of the oil circuit 505. The oil pump 510 is mechanically connected to the engine 110 and therefore is driven as a function of engine speed.

The valve 500 separates the main oil gallery 570 from a piston cooling jets oil gallery 550 leading to the piston cooling jets 560. Therefore an oil inlet 610 of valve 500 is connected to the main oil gallery 570. Also, an air inlet 660 of the valve 500 is connected to the intake manifold, while an outlet 630 of valve 500 is connected to the piston cooling jets oil gallery 550 leading to the piston cooling jets 560. As explained in greater detail in the following description, valve 500 is a mechanical valve that can be controlled by the oil pressure of the oil in the main oil gallery and by the air pressure from the intake manifold 220.

Figure 4:
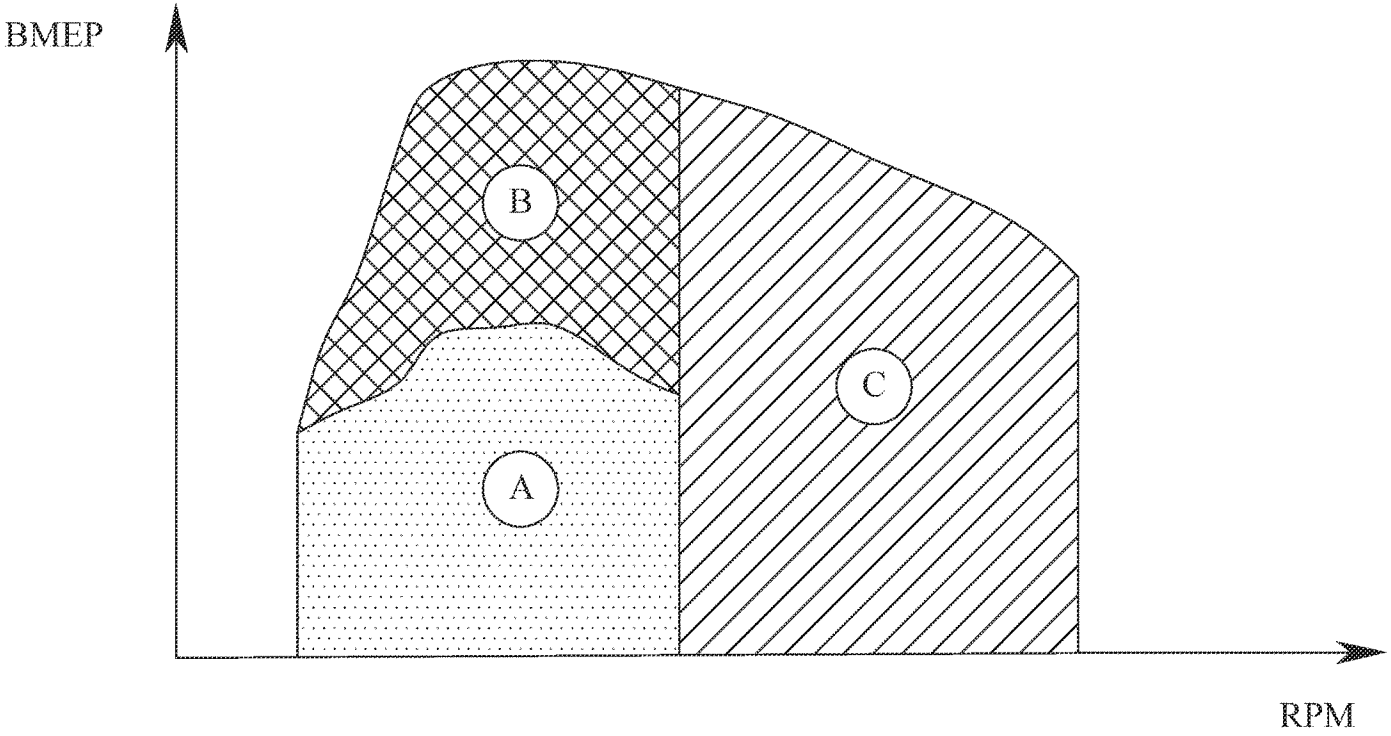
FIG. 4 is a graph representing different operating conditions of the piston cooling jets.

In FIG. 4 different operating conditions of the piston cooling jets 560 are represented as a function of engine speed and engine load, this latter parameter being measured in terms of BMEP (Brake Mean Effective Pressure). Three different situations respectively indicated with A, B and C can occur. At low engine speed and low engine load (area A), the piston cooling jets 560 are not operating since there is no need for cooling the pistons 140. At high load and low engine speed (area B), the piston cooling jets 560 are operating, in particular for improving cooling and improving lubrication of the pistons. Finally, at high engine speed (area C), the piston cooling jets 560 are also operating for improving cooling and improving lubrication of the pistons.

Figures 5, 6, 7:
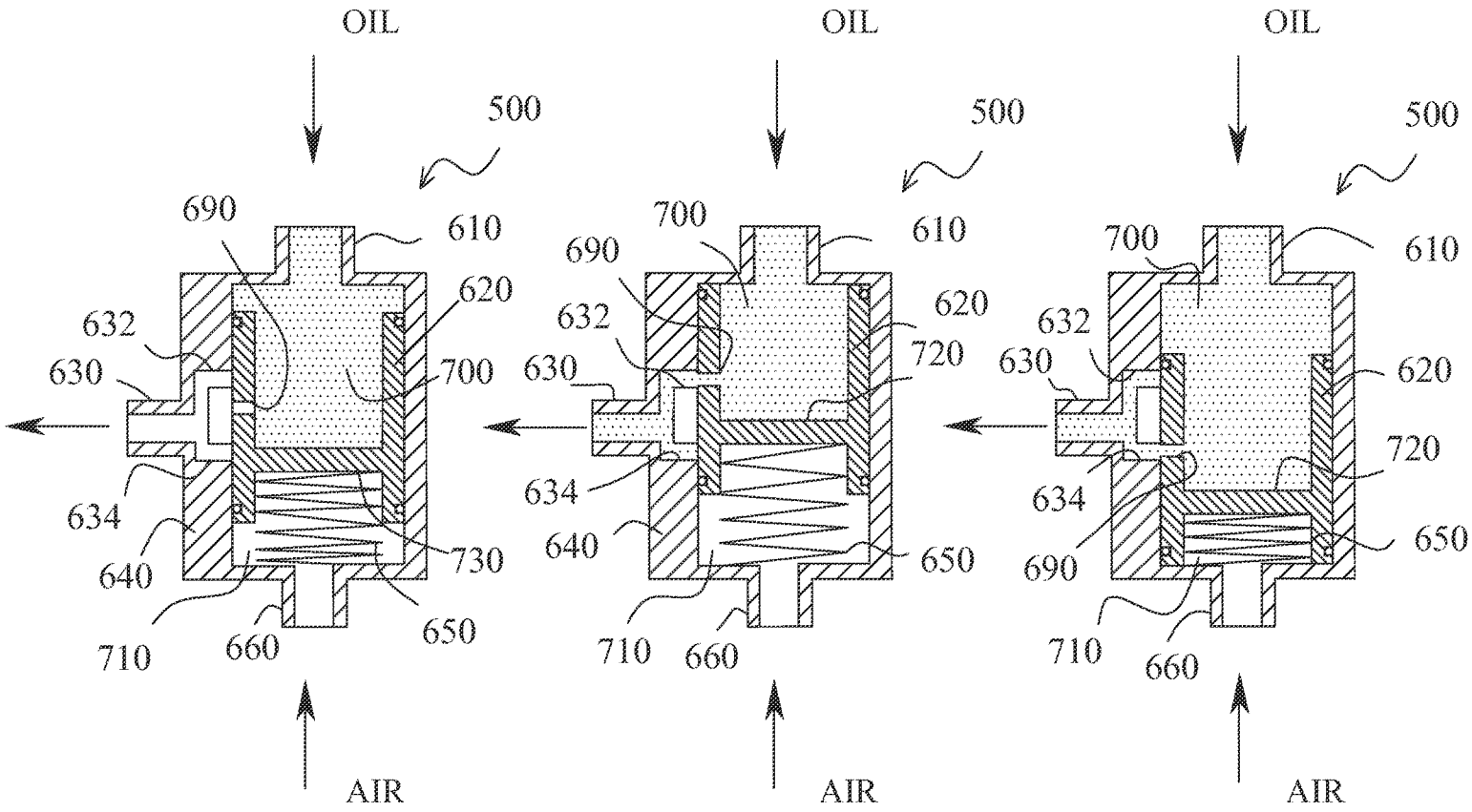
FIG. 5 represents a valve for controlling piston cooling jets, according to an embodiment of the present disclosure, in a first operating condition.
FIG. 6 represents a valve for controlling piston cooling jets, according to an embodiment of the present disclosure, in a second operating condition.
FIG. 7 represents a valve for controlling piston cooling jets, according to an embodiment of the present disclosure, in a third operating condition.

In FIGS. 5-7 valve 500 is represented in different operating conditions. As mentioned above, valve 500 is provided with a valve body 640, the valve body 640 being in turn equipped with oil inlet 610 connected to the main oil gallery 570, an air inlet 660 connected to the intake manifold 220 and an outlet 630 connected to the oil gallery 550. The oil inlet 610 allows oil to enter an oil chamber 700 in the valve body 640 and the air inlet 660 allows air to enter an air chamber 710 in the valve body 640. The valve body 640 is also equipped with two openings 632,624 that may fluidly connect the oil chamber 700 to outlet 630.

Valve 500 is also equipped with a valve element 620 which separates the oil chamber 700 in the valve body 640 from the air chamber 710. Valve element 620 is configured with a substantially H-shaped section provided with a first surface 720 delimiting the oil chamber 700 and with a second surface 730 delimiting the air chamber 710. Valve element 620 can move along an axial direction inside valve body 640 as a consequence of different oil and air pressure conditions, depending on different operating points. In the air chamber 710, an elastic means such as a spring 650 is provided, the spring 650 being connected to the second surface 730 of valve element 620. Valve element 620 is also equipped with an aperture 690 suitable to cooperate with openings 632,624 in order to fluidly connect the oil chamber 700 to outlet 630.

The operations of valve 500 are as follows. Valve 500 is designed in such a way that, at low engine speed and low engine load (FIG. 5), the effect of oil pressure from the main oil gallery 570 on first surface 720 and air pressure from the intake manifold 220 on second surface 730 are balanced and the position of valve element 620 is such that aperture 690 is included between openings 632, 624 and therefore valve 500 is closed. In this case, oil from then engine oil lubrication circuit 505 does not reach the piston cooling jets are not operating.

At high load and low engine speed (FIG. 6), air pressure from the intake manifold 220 increases with respect to oil pressure from the main oil gallery 570 by effect of the compressor 240. Valve element 620 is therefore lifted until aperture 690 is in correspondence with opening 632 in order to allow the connection of oil inlet 610 with oil outlet 630. Therefore valve 500 is opened and the piston cooling jets 560 are actuated.

Finally, at high engine speed (FIG. 7), the oil pressure from the main oil gallery 570 increases due to the increase of engine speed acting on the pump 510. The increased oil pressure pushes valve element 620 against the resistance of spring 650 until aperture 690 is in correspondence with opening 634 in order to allow the connection of oil inlet 610 with oil outlet 630. Therefore, also in this case, valve 500 is opened and the piston cooling jets 560 are also actuated.

The various embodiments described therefore allow control of the piston cooling jets 560 without the need of a solenoid valve and the use of specialized software to be run by the ECU 450.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. A valve for controlling piston cooling jets in an internal combustion engine, the valve comprising:

a valve body having an oil inlet configured to draw oil from an oil gallery, an oil outlet configured to connect with a piston cooling jet gallery, an air inlet configured to draw air from an intake manifold of the engine; and a valve element slidably supported in the valve body and configured to be actuated by a pressure differential between oil entering the oil inlet and air entering the air inlet, wherein the valve element is configured to maintain a closed position in which the oil outlet is closed when the air pressure balances the oil pressure.

2. The valve according to claim 1, wherein the valve element is configured to move to an open position in which the oil outlet is opened when the air pressure exceeds the oil pressure.

3. The valve according to claim 1, wherein the valve element is configured to move to an open position in which the oil outlet is opened when the oil pressure exceeds the air pressure.

4. The valve according to claim 1, wherein the valve element is movable along an axial direction inside valve body in response to the pressure differential.

5. The valve according to claim 4, wherein the valve body further has at least one opening in fluid connection with the oil outlet, and wherein the valve element has at least one aperture configured to establish a fluid connection between the oil inlet and the oil outlet.

6. The valve according to claim 1, wherein the valve element divides the valve body into an oil chamber fluidly connected to the oil inlet and an air chamber fluidly connected to the air inlet.

7. The valve according to claim 6, further comprising a spring housed in the air chamber and operably coupled to the valve element.

8. The valve according to claim 1, wherein the valve element divides the valve body into an oil chamber fluidly connected to the oil inlet and an air chamber fluidly connected to the air inlet; and wherein the valve further comprises a spring housed in the air chamber and operably coupled to the valve element, wherein the valve element is configured maintain a first position as the closed position when the air pressure balances the oil pressure, a second position in which the oil outlet is opened when the air pressure exceeds the oil pressure, and a third position in which the oil outlet is opened when the oil pressure exceeds the air pressure.

9. A valve for controlling piston cooling jets in an internal combustion engine, the valve comprising:

a valve body having an oil inlet configured to draw oil from an oil gallery, an oil outlet configured to connect with a piston cooling jet gallery, an air inlet configured to draw air from an intake manifold of the engine; and a valve element slidably supported in the valve body and configured to be actuated by a pressure differential between oil entering the oil inlet and air entering the air inlet, and wherein the valve element is configured to move to an open position in which the oil outlet is opened when the air pressure exceeds the oil pressure or when the oil pressure exceeds the air pressure.

10. The valve according to claim 9, wherein the valve element is configured to maintain a closed position in which the oil outlet is closed when the air pressure balances the oil pressure.

11. An oil circuit for an internal combustion engine comprising:

an oil gallery including a first gallery region and a second gallery region;

a valve separating the first and second gallery regions, the valve including a valve body having an oil inlet in fluid communication with the first oil region, an oil outlet in fluid communication with the second gallery region and, an air inlet configured to draw air from an intake manifold of the engine, and a valve element slidably supported in the valve body in response to a pressure differential between oil entering the oil inlet and air entering the air inlet; and at least one piston cooling jet in fluid communication with the second gallery region and configured to cool a piston of the internal combustion engine, wherein the valve element is movable along an axial direction inside valve body in response to the pressure differential, and wherein the valve body further has at least one opening in fluid connection with the oil outlet, and wherein the valve element has at least one aperture configured to establish a fluid connection between the oil inlet and the oil outlet.

12. The oil circuit according to claim 11, wherein the valve element is configured to maintain a closed position in which the oil outlet is closed when the air pressure balances the oil pressure.

13. The oil circuit according to claim 11, wherein the valve element is configured to move to an open position in which the oil outlet is opened when the air pressure exceeds the oil pressure.

14. The oil circuit according to claim 11, wherein the valve element is configured to move to an open position in which the oil outlet is opened when the oil pressure exceeds the air pressure.

15. The oil circuit according to claim 11, wherein the valve element divides the valve body into an oil chamber fluidly connected to the oil inlet and an air chamber fluidly connected to the air inlet.

16. The oil circuit according to claim 15, further comprising a spring housed in the air chamber and operably coupled to the valve element.

* * * * *